United States Patent [19]

Tisell et al.

[11] 4,242,945

[45] Jan. 6, 1981

[54] ASSEMBLY WITH RELATIVELY DISPLACEABLE MEMBERS

[75] Inventors: Claes-Gustav E. Y. Tisell, Strangnas; Karl E. B. Lundell, Bromma; Sven H. N. Horner, Eskilstuna; Gustav Y. Thorstensson, Sollentuna; Gustav S. E. Karlstedt, Sollentuna, all of Sweden

[73] Assignee: Forenade Fabriksverken, Eskilstuna, Sweden

[21] Appl. No.: 721,220

[22] Filed: Sep. 8, 1976

Related U.S. Application Data

[63] Continuation of Ser. No. 534,812, Dec. 20, 1974, abandoned.

[30] Foreign Application Priority Data

Dec. 21, 1973 [SE] Sweden ..... 7317345

[51] Int. Cl.[3] ..... F15B 15/26

[52] U.S. Cl. ..... 92/26; 92/27; 92/30; 188/67

[58] Field of Search ..... 92/19, 23, 30, 26, 27, 92/28; 60/632, 633, 634, 635, 636, 637, 638, 639; 85/65; 188/67

[56] References Cited

U.S. PATENT DOCUMENTS

| | | | |
|---|---|---|---|
| 2,449,516 | 9/1948 | Shakespeare | 188/67 |
| 2,515,712 | 7/1950 | Horton . | |
| 2,800,819 | 7/1957 | Smith | 188/67 |
| 2,878,901 | 3/1959 | Runner | 188/67 |
| 3,166,990 | 1/1965 | Hoffmann | 92/30 |
| 3,221,610 | 12/1965 | King | 92/24 |
| 3,353,454 | 11/1967 | Donovan . | |
| 3,455,566 | 7/1969 | Hull . | |
| 3,554,564 | 1/1971 | Lassanske . | |
| 3,597,016 | 8/1971 | Gachot | 188/67 |

FOREIGN PATENT DOCUMENTS

| | | | |
|---|---|---|---|
| 1142814 | 2/1969 | United Kingdom | 92/28 |
| 1188100 | 4/1970 | United Kingdom . | |

*Primary Examiner*—Abraham Hershkovitz
*Attorney, Agent, or Firm*—Fleit & Jacobson

[57] ABSTRACT

An assembly comprising an inner and an outer cylindrical members, the inner member being displaceable within the outer member and provided with an annular recess, a locking ring being housed in the recess to allow displacement of the inner member in a first direction but locking the members relative one another upon attempt to displace the inner member in a second direction.

10 Claims, 5 Drawing Figures

ASSEMBLY WITH RELATIVELY DISPLACEABLE MEMBERS

This is a continuation of application Ser. No. 534,812, filed Dec. 20, 1974, now abandoned.

The present invention relates to an assembly wherein two relatively displaceable members, such as a piston and a cylinder, can be arrested relatively one another.

In a known piston-and-cylinder assembly disclosed in U.S. Pat. No. 3,166,990 it has been proposed to form an annular recess in the piston, a resilient split coupling ring being received in the recess, and an annular recess being formed in the wall of the cylinder. The recesses are formed with two pairs of flanks which, in the aligned position of the recesses, bear upon the coupling ring such that the coupling ring locks the piston and cylinder against further relative displacement in one direction but permits relative displacement in the opposite direction. Hence the known device can only be used for arresting the piston in the predetermined relative position where said recesses are aligned with one another.

The object of the present invention is therefore to provide an assembly with relatively displaceable members which can be arrested in any desired relative position.

Further objects and advantages of the present invention will become apparent from the following detailed description of the invention taken with the accompanying drawing in which.

Figure 1:
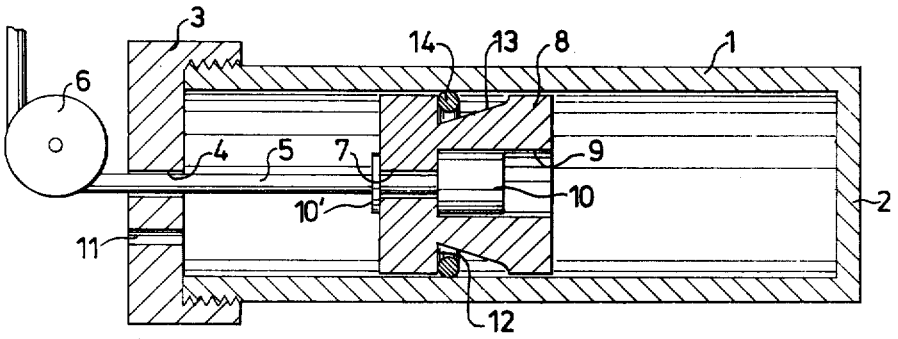
FIG. 1 is a longitudinal sectional view of a piston-and-cylinder assembly in accordance with the present invention.
Figure 2A:
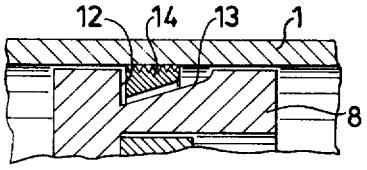
FIGS. 2–4 are partial longitudinal sectional views illustrating modified embodiments of the coupling element and piston employed in the assembly of FIG. 1.
Figure 2B:
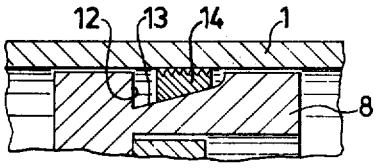

Referring to the drawing, especially FIG. 1, numeral 1 designates a cylinder having a closed end 2. The opposite end of the cylinder has an end wall 3 detachably secured thereto. A flexible cable 5 extends through an opening 4 formed in the wall 3. The cable 5 rides over a pulley 6 and has one of its ends attached to a load device such as a safety belt mechanism. The cable 5 extends through a central axial opening 7 formed in a piston 8 which is housed displaceably within the cylinder 1.

The opening 7 communicates with an exlarged cylindrical boring 9 formed in the piston 8. The cable 5 is fixed to a cylindrical body 10 received within the boring 9. The diameter of the cylindrical body 10 is insignificantly less than that of the boring 9. A locking disc 10' embraces the cable 5 and prevents movement of the cylindrical body 10 within the boring 9. The cylindrical body 10 may be replaced by a pulley or a suitable curved element arranged within the boring 9 such that the cable rides over the pulley or the curved element and returns through a second opening in the piston to the wall 3 to which it may be fixedly secured. In this way, the length of the cylinder stroke is reduced by one half.

The wall 3 has an inlet conduit 11 for pressure fluid formed therein. The pressure fluid may be a gas generated by the firing of an explosive cartridge or a powder dose. The explosive cartridge or powder dose may be located within one of the cylinder chambers or within the wall of said cylinder chamber.

The piston 8 has an annular recess 12, 13 formed in its peripheral surface at an intermediate location. The annular recess has a substantially V-shaped cross-section with a beveled forward flank 13 and a rear flank 12 lying in a radial plane of the piston. The beveled flank 13 forms an angle with the axis of piston that is less than 30 degrees, preferably less than 20 degrees. A flexible split piston ring 14 is lodged in the recess 12, 13. The resiliency of the ring 14 urges it radially outwardly toward the inner peripheral wall of the cylinder 1.

When admitting pressure gas into the cylinder 1, for example through the conduit 11, the piston 8 moves inwardly away from the wall 3 to exert through the cable 5 a pulling force on the load device. In this way, the rear flank 12 bears equatorially upon the ring 14 when the piston is moved inwardly. However, if the pressure behind the piston 8 is decreased and the load device exerts a force through the cable 5 to pull the piston backwards, the friction force between the ring 14 and the inner peripheral wall of the cylinder 1 will urge the ring 14 to the right in FIG. 1, thereby causing the beveled flank 13 to apply to the ring an outward pressure toward the inner peripheral wall of cylinder 1 such that the ring 14 will be jammed like a wedge between the flank 13 and the inner peripheral wall of the cylinder 1 whereby the ring 14 locks the piston 8 against further movement in any direction.

In order to facilitate the locking function, the ring 14 can be provided with a high-frictional surface facing the inner peripheral surface of the cylinder to increase the friction between the ring 14 and the inner wall of the cylinder 1. Said surface may be grooved, as shown in FIGS. *2a* and *2b*. FIG. *2a* illustrates the position of the ring when moving the piston 8 inwardly, whereas FIG. *2b* illustrates the jammed position of the ring 14. The friction between the ring 14 and the beveled flank 13 may be decreased by providing the flank 13, for example, with low-frictional surfaces, for example polished surfaces.

Figure 3:
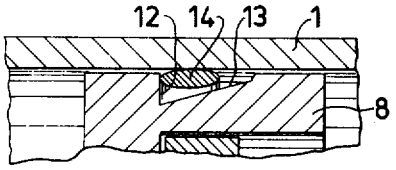

In FIG. 3 there is shown a piston ring 14 of oval cross-section. This shape of the ring 14 may facilitate the jamming wedge function.

Figure 4:
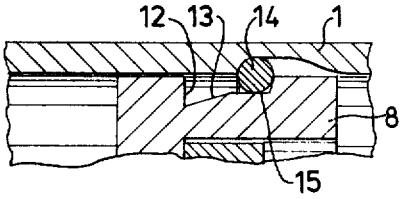

According to the embodiment shown in FIG. 4 the wall of the cylinder 1 is made of softer material than the piston 8. The wall of the cylinder may for example be made of aluminium and the piston of steel. When the cable 5 is urging the piston outwardly of the cylinder 1 the wall of the cylinder will be deformed and strengthen the locking of the piston. The flank 13 of the recess is then preferably provided with a first annular beveled surface and a second annular cylindrical surface 15 having less diameter than the piston 8. The depth of penetration of the ring 14 into the wall of the cylinder 1 is depending on the diameter of the cylindrical surface 15.

By suitable choice of material in piston 8, cylinder 1 and ring 14, of the cross-sectional configuration of the ring 14 and also of the configuration of the flank 13, any desired locking force can be obtained, irrespectively if the wall is to be deformed or not. The assembly can also function as a power restricting means. If the pulling force of the cable 5 exceeds the locking force a continous deformation of the cylinder wall is achieved during the return stroke of the piston. This would be similar to a cold drawing of the material.

When using the same material in the ring 14 and in the cylinder wall the piston is substantially locked only by friction forces. However, according to preferred embodiments of the invention the piston is locked by the combined effect of frictional forces and deformation of the cylinder wall. The cylinder wall may be deformed by making it from softer material or by making it relatively thin.

According to a further embodiment the ring 14 has differently sized bearing surfaces against the wall of the cylinder 1 and the flank 13.

The invention in its broader aspects is, of course, not limited to a piston-and-cylinder assembly but may be utilized in conjunction with other members that are relatively displaceable. Modifications of the assembly described and shown are, therefore, possible without departing from the spirit and scope of the invention as defined in the appended claims.

We claim:

1. An assembly comprising an inner and an outer cylindrical member, respectively, the inner member being relatively axially displaceable along the inner peripheral surface of the outer member, means for axially displacing said inner member relatively to said outer member, the inner member being provided with an annular peripheral recess, a resilient split ring being lodged in the recess fully retractable into same but elastically biased in radial direction toward the inner peripheral surface of the outer member, the recess having a first flank and a second flank, the first flank lying in a radial plane of the inner member, the second flank extending in a plane oblique to the longitudinal center line of the inner member, forming an angle with the longitudinal axis of said inner member that is less than 30°, the first flank bearing equatorially on the ring upon axial displacement of the inner member relative to the outer member in a first direction, and upon axial displacement of the inner member relative to the outer member in a second direction said ring is displaced from bearing upon said first flank and said ring is caused to move along said second flank such that the second flank is applying to the ring a substantially radial outward jamming pressure toward the inner peripheral surface of the outer member whereby the ring is jammed like a wedge and locks the inner member against substantial displacement in the second direction.

2. An assembly as defined in claim 1, wherein the ring is provided with a high-frictional surface toward the inner peripheral surface of the outer member.

3. An assembly as defined in claim 1, wherein the ring is provided with a low-frictional surface toward the second flank of the recess.

4. An assembly as defined in claim 1, wherein the second flank of the recess is provided with a low-frictional surface.

5. An assembly as defined in claim 1, wherein the outer member is made of softer material than the ring and the inner member.

6. An assembly as defined in claim 1, wherein the ring has circular cross-section.

7. An assembly as defined in claim 1, wherein the ring has oval cross-section.

8. An assembly as defined in claim 1, wherein the ring has wedge-shaped cross-section.

9. An assembly as defined in claim 1, wherein the second flank has a first annular beveled surface one annular inner end edge of which lies in the plane of the first flank and having a second annular cylindrical surface with less diameter than that of the inner member, one annular outer end edge of the beveled surface defining one annular end edge of the second annular cylindrical surface.

10. An assembly as defined in claim 1 wherein the area of the bearing surface of said ring engagable with the inner peripheral surface of the outer member is substantially less than the area of the bearing surface of said ring engagable with the second flank.

* * * * *